United States Patent [19]

Jordan et al.

[11] Patent Number: 4,973,522

[45] Date of Patent: Nov. 27, 1990

[54] ALUMINUM ALLOY COMPOSITES

[75] Inventors: Richard M. Jordan, Nook Norton; John White, Steeple Aston; Treve C. Willis, Oxon, all of England

[73] Assignee: Alcan International Limited, Montreal, Canada

[21] Appl. No.: 201,776

[22] Filed: Jun. 2, 1988

[30] Foreign Application Priority Data

Jun. 9, 1987 [GB] United Kingdom ..... 8713449

[51] Int. Cl.[5] ..... C22C 32/00

[52] U.S. Cl. ..... 428/614; 148/415; 148/416; 148/417; 148/418

[58] Field of Search ..... 428/614; 148/415, 416, 148/417, 418

[56] References Cited

U.S. PATENT DOCUMENTS

| | | | |
|---|---|---|---|
| 4,012,204 | 3/1977 | Riewald et al. | 428/614 |
| 4,053,011 | 10/1977 | Riewald et al. | 428/570 |
| 4,662,429 | 5/1987 | Wada et al. | 428/627 |

FOREIGN PATENT DOCUMENTS

| | | | |
|---|---|---|---|
| 0295008 | 12/1988 | European Pat. Off. | 428/614 |
| 60-187637 | 9/1985 | Japan | 428/614 |
| 60-194039 | 10/1985 | Japan | 428/614 |
| 1506476 | 4/1978 | United Kingdom | 428/614 |

OTHER PUBLICATIONS

White et al., "Metal Matrix Composites Based on Aluminum . . . ", Journal De Physique, C3-347/C3-353, Sep. 1987.

Webster, "Effect of Lithium on the Mechanical . . . ", Metall. Trans. A., vol. 13A, Aug. 1982, p. 1511-1519.

Pritchett, "Advanced Technology Aluminum Materials . . . ", Light Metal Age, Aug. 1986, pp. 10-14.

Metzger et al., "Corrosion of Aluminum-Matrix Composites . . . ", Ind. Eng. Chem. Prod. Res. Dev., vol. 22, No. 2, Feb. 1983, p. 296-302.

*Primary Examiner*—Theodore Morris
*Assistant Examiner*—David Schumaker
*Attorney, Agent, or Firm*—Cooper & Dunham

[57] ABSTRACT

A metal matrix composite may be produced by atomizing a stream of molten aluminum-lithium alloy to form a spray of hot metal particles by subjecting the stream to relatively cold gas directed at the stream, applying to the stream or spray fine solid particles of reinforcement e.g. silicon carbide, and depositing the metal having the fine particles incorporated therein. The resulting composite has the following properties in an extruded and age hardened state:

0.2% Proof strength - at least 400 MPa
Tensile strength - at least 440 MPa
Elongation - at least 2.0%
Modulus of elasticity - at least 85 GPa
Density - maximum 2.75 $Mg/m^3$.

9 Claims, No Drawings

ALUMINUM ALLOY COMPOSITES

This invention relates to aluminium alloy materials which exhibit high strength and stiffness combined with substantial ductility. The materials are composites based on aluminium-lithium alloys with reinforcement and are produced by spray deposition.

There has been considerable effort devoted to the development of aluminium based alloys with high stiffness aimed predominantly at aerospace applications. One approach to such materials has concentrated on the development of conventional ingot casting techniques to produce aluminium alloys containing up to 3% by weight of lithium. These alloys achieve improvements in modulus of about 10% (to about 80 GPa) with a decrease in density also of about 10% (to about 2.54 $Mg/m^3$). It is well known that Al-Li alloys suffer from poor ductility. Indeed, brittleness problems effectively limit to about 3% the amount of Li that can be incorporated in Al alloys produced by ingot metallurgy. Alternative production routes, e.g. by powder metallurgy, have received relatively little attention due to the extra processing costs involved.

A second approach to the development of materials with improved strength/stiffness to weight ratios has been that of metal matrix composites. This group of materials offers the potential for much greater increases in modulus (more than 150 GPa) compared with Al-Li alloys. The development of these materials has primarily concentrated on the production of reinforced alloys containing either whiskers or fibres. These have required complex processing routes and this, combined with expensive starting materials, has resulted in substantial cost penalties albeit with impressive improvements in modulus. The use of reinforcement with a high aspect ratio also leads to considerable anisotropy. More recently attention has been focussed on particulate reinforced metal matrix composites which, although producing comparatively modest improvements in modulus, are isotropic. This type of metal matrix composite has been produced by a variety of routes, the most widely reported of which has been that of powder mixing. It is well known that the incorporation of reinforcement in Al alloys not only increases the modulus, but also decreases the ductility. The incorporation of 10% by volume of particulate reinforcement may typically be expected to reduce the ductility of an Al alloy to around 25% of its previous value. Metal matrix composites therefore generally have low ductility and are not used in applications where ductility is important.

For example D. Webster (Met. Trans., 13A, p.1511, 1982) prepared metal matrix composites based on Al-Li alloys reinforced with SiC whiskers by powder metallurgy techniques. But all except one were reported to be brittle and to fail before the tensile 0.2% yield strength was reached; the one exception (ductility not stated) was based on a low-strength binary Al-Li alloy.

EPA 45622 concerns dispersion strengthened mechanically alloyed aluminium-lithium alloys. The dispersoid is of sub-micron size and is formed in situ.

Von Bradsky G. et al (Journal of Materials Science, 22, (1987) 1469–1476) describes the production of rapidly solidified powders, below 10 microns in size, of an Al-Li alloy by gas atomisation.

A method making metal deposits (e.g. of aluminium) by spray casting is described in a series of patents of which GB Nos. 1379261 and 1472939 are representative. The technique comprises the steps of atomising a stream of molten metal to form a spray of hot metal particles by subjecting the stream of molten metal to high velocity, relatively cold gas directed at the stream, and directing the spray of particles at a former to form thereon the desired deposit, the temperature and flow rate of the gas being determined so as to extract a critical and controlled amount of heat from the atomised metal particles both during flight and on deposition, whereby the solidification of the deposit is not dependent on the temperature and/or the thermal properties of the former. The molten metal droplets have an average diameter in excess of 10 microns, typically 50–200 microns. By this means are obtained deposits which are substantially non-particulate in nature, free from segregation, over 95% dense and which possess a substantially uniformly distributed closed internal pore structure.

Use of the spray casting technique to make metal matrix composite materials is described in British Patent Specification Nos. 2172825 and 2172827.

The present invention is based on several surprising discoveries. First, known spray casting techniques can be used with Al-Li alloys; production of the material has been found to be surprisingly easy, and the alloy does not result in the blocking of the spray nozzle as might have been anticipated. Second, incorporation of reinforcements in the spray cast material, not only increases the stiffness, but also gives rise to a deposit which can be mechanically worked and processed to have substantial and surprising ductility. (Typically, incorporation of 10% by volume of particulate reinforcement may provide a product having a ductility at least half as great as that of the alloy without the reinforcement.) Third, it is surprising that ingot produced by spray deposition shows no evidence of cracking caused by residual stresses, since such cracking is a major problem in Al-Li ingots cast by conventional techniques. (Journal de Physique, Colloq. C3, Supplement No. 9, Tome 48, Sept 1987, paper by P. E. Bretz at page 26. See also GB No. 1605035 which indicate that conventional spray casting processes give rise to residual tensile stresses within the last deposited layers of the metal which tend to cause cracking of the deposit or distortion of the substrate).

The present invention provides a metal matrix composite produced by spray casting comprising an Al-Li alloy matrix and a reinforcement and having the following properties in an extruded and age hardened state:

0.2% Proof strength—at least 400 MPa
Tensile strength—at least 440 MPa
Elongation—at least 2.0%
Modulus of elasticity—at least 85 GPa
Density—maximum 2.75 $Mg/m^3$.

The invention covers composites in the as-cast state, which may be to some extent porous, and also all product forms made therefrom, including forgings, extrusions, castings, rolled products (sheet and plate) and tubes. The above-stated properties apply to the material in the extruded and age-hardened state. It will be understood that the invention covers also products which do not necessarily have these properties, but in which these properties can be generated by extrusion and age-hardening.

The metal matrix composite may comprise from 1 to 50% by volume, typically 5 to 30% by volume, and preferably 10 to 15% by volume, of the ceramic reinforcement. If the reinforcement content is too low, the composite may not have the required modulus of elasticity. If the reinforcement content is too high, the composite may not have the required ductility.

The reinforcement is preferably particulate, with an aspect ratio of no more than 5:1. The average particle diameter may be in the range 1 to 100 microns, typically 5 to 40 microns, preferably 5 to 15 microns. Alternatively, the reinforcement may be in the form of continuous or discontinuous fibres, or whiskers or staple, having an average fiber diameter preferably in the range 0.1 to 500 microns usually from 1 to 50 microns. But particulate reinforcement is preferred, because particles are much cheaper than the other forms and can give rise to isotropic composites having excellent properties.

The reinforcement is chosen to have a higher modulus than the alloy into which it is incorporated. It may typically be a high modulus carbide, oxide, boride or nitride, such as for example, silicon carbide, alumina or boron carbide. Such ceramic reinforcements for metal matrix composites are well known in the art.

The metal matrix contains Li in a concentration up to 10%, typically from 1.0 to 3.0% by weight. Although Li does increase the strength of the alloy, its main function is to reduce the density. Enough needs to be present, taking into account the other alloying constituents and the ceramic reinforcement, to keep the density of the (fully compacted) composite below 2.75 $Mg/m^3$. When high Li levels are used, care may be needed in formulating the composite to achieve the desired ductility.

The metal matrix may contain other ingredients, such as are conventional in Al-Li alloys, as follows (in weight %):

| | |
|---|---|
| Copper | up to 5.0, preferably 1.0 to 2.2% |
| Magnesium | up to 10.0, preferably 0.5 to 1.3% |
| Zirconium | up to 0.20, preferably 0.04 to 0.16% |
| Iron | up to 0.5% |
| Silicon | up to 0.5% |
| Zinc | up to 5.0% |
| Titanium | up to 0.5% |
| Manganese | up to 0.5% |
| Chromium | up to 0.5% |
| Others, each up to 0.5% | |
| Others, total up to 1.0% | |

Incorporation of at least one of Cu, Mg and Zr, preferably all three, is likely to be necessary to achieve the desired strength properties.

The metal matrix composites of this invention may be made by spray casting using the technique of British Patent Specification Nos. 2172825 and 2172827. In general terms this technique comprises the steps of atomising a stream of the molten Al-Li alloy to form a spray of hot metal particles by subjecting the stream to relatively cold gas directed at the stream, applying to the stream or spray fine solid particles of the reinforcement and depositing the metal having the fine particles incorporated therein. In practice, the reinforcement may be injected at room temperature or at temperatures up to the super heat of the metal being sprayed and may be fed into the molten metal in a number of regions. It is however preferred to feed the reinforcement into the so-called "atomising zone" either just before or immediately after the molten metal begins to break up into a spray. The atomising gas may be argon or nitrogen, normally at ambient temperature but always at a temperature less than the melting point of the Al-Li alloy being sprayed. If desired the reinforcement may be injected with and carried by the atomising gas, or carried by a separate flow of gas, or gravity fed or vibration fed into the atomising zone.

The resulting deposited metal matrix composite can be subjected to standard metal forming techniques such as machining, forging, extruding, rolling and casting; and can be heated and worked as required to develop desired properties. In the extruded and age-hardened state, the composite is characterized by having the following properties:

(a) 0.2% proof strength of at least 400 MPa, preferably at least 440 MPa; and ultimate tensile strength of at least 440 MPa, preferably at least 480 MPa. These properties are achieved mainly by control over the concentrations of Li and other alloying ingredients of the metal matrix in a manner well understood in the field.

(b) A modulus of elasticity of at least 85 GPa, preferably at least 93 GPa. This property is achieved mainly by choice of the nature, form and concentration of the reinforcement, in a manner well known in the field.

(c) A density of not more than 2.75 $Mg/m^3$, preferably not more than 2.70 $Mg/m^3$. This property is achieved by control over the Li deposition of the alloy.

(d) An elongation to break of at least 2.0% preferably at least 2.3%. This property arises, surprisingly, as a result of the spray casting technique used to form the composite.

EXAMPLE 1

The spray casting equipment was purchased from Osprey Metals, Neath and further developed at the Banbury Laboratories of Alcan International Limited. The equipment comprises a refractory oxide nozzle of 4.5 mm internal diameter for passing by gravity a stream of molten metal. Surrounding the nozzle is a primary gas nozzle with apertures to direct a primary support gas flow parallel to and surrounding the metal stream, to shroud and contain the molten metal. Surrounding the primary gas nozzle is a secondary gas nozzle provided with jets which direct a secondary atomizing gas stream towards the molten metal stream. The secondary gas stream contacts the molten metal stream at a distance h downstream of the nozzle and atomizes it into a spray of metal particles.

The secondary atomizing gas flow defines a cone of height of h and radius equal to the distance of the jets from the metal stream. Reinforcement particles, entrained in a carrier gas, are introduced into this cone via a pipe.

The molten metal sprayed had the following composition, in weight per cent. Li, 2.3; Cu, 1.08; Mg, 0.50; Zr, 0.12; Fe, 0.08; Si, 0.04; Al, balance. This composition is at the lower end of the specified compositional range of alloy 8090 on the Aluminum Association Inc. Register. The ceramic reinforcement used was a silicon carbide grit (F600, grade 3 of Sika) having a mean diameter of 13 microns. The melt spray temperature was 700° to 705° C. The atomising gas used was nitrogen, at a primary gas pressure of 0.3 MPa and a secondary gas pressure of 0.6 MPa. A spray deposition experiment lasting about eighty seconds gave rise to a deposit weighing 8.3 kg.

The deposit was machined to an extrusion billet 80 mm in diameter and 228 mm in length Homogenisation was carried out by heating the ingot slowly up to 540°

C. and holding it at that temperature for twenty four hours. Extrusion was carried out at an extrusion ratio of about 20:1 giving a round bar of 18 mm diameter. The extruded bar was solution heat treated in an air oven for 15 minutes at 535° C. and cold water quenched. The bar was stretched 2% prior to ageing. Ageing was carried out at 150° C. for 40 hours, a treatment which gave near peak properties.

In the as-sprayed deposit, the silicon carbide was uniformly distributed. The as-produced phases were evenly distributed throughout the matrix and not significantly associated with the interface between matrix and silicon carbide. The phase distribution was considerably refined when compared with conventionally cast 8090 alloy. Refinement of microstructure was also observed in the fine as-produced grain size which was approximately 50 microns.

The homogenisation treatment was successful, resulting in dissolution of virtually all the as-produced phases with the exception of iron containing intermetallics. The overall volume fraction of the silicon carbide was 11.8% of the composite.

In the extruded bar, the silicon carbide was uniformly distributed. The extrusion process, however, resulted in the alignment of the particles in the direction of extrusion. Porosity observed in the original ingot closed up during extrusion. Additional precipitation, which occurred during extrusion, was readily dissolved on solution heat treatment.

The extruded bar, after solution heat treatment, cold water quenching, stretching and ageing at 150° C. for forty hours was found to have the following mechanical properties on test pieces with a 40 mm gauge length:

0.2% proof strength—486 MPa
Tensile strength—529 MPa
Elongation—2.6%
Modulus of elasticity—100.1 GPa
Density—2.62 $Mg/m^3$ Despite the preliminary nature of the material under investigation, the general properties of the composite compare favourably with those of conventionally cast and extruded (unreinforced) 8090 alloy. The major difference is the significant increase in elastic modulus. This corresponds to a greater than 30% increase in modulus over conventional aluminium alloys, and about 50% increase in the stiffness to density ratio. And this has been achieved without excessive loss of ductility. Reinforcement of Al-Li alloys using silicon carbide whisker and alumina has generated products having high elastic moduli, but very poor ductility and fracture toughness.

It may be anticipated that the addition of a higher proportion of silicon carbide (or other reinforcement) to Al-Li alloy described above will result in a further improvement in an elastic modulus, albeit at the cost of some reduction in ductility.

EXAMPLE 2

Further mechanical properties have been obtained on extrudate produced in a manner similar to that in Example 1. These relate to increasing the stretch prior to ageing and its effect on properties.

| Level of Stretch | 0.2% P.S. (MPa) | T.S. (MPa) | Ef (%) | E (GPa) |
|---|---|---|---|---|
| 0% | 451.2 | 508.4 | 2.7 | 94.4 |
| 2% | 499.4 | 539.8 | 3.1 | 95.2 |
| 5% | 518.8 | 555.9 | 3.4 | 95.6 |

These properties show an improvement in strength over the original data as well as higher ductilities.

The composition of the alloy was

| | |
|---|---|
| 2.43 | Li |
| 1.12 | Cu |
| 0.61 | Mg |
| 0.15 | Zr |
| 0.036 | Ti |
| 0.06 | Fe |
| 0.06 | Si |
| Balance | Al |

EXAMPLE 3

Boron Carbide $B_4C$ can be envisaged as a potentially better reinforcement, compared with SiC, for Al-Li alloys. It was anticipated that the incorporation of $B_4C$ rather than SiC into Al-Li alloys would result in similar elastic moduli and mechanical properties but would reduce the density of the finished composite to approximately 2.52 g/cc as a result of the lower density of the reinforcement (2.5.g/cc for $B_4C$ compared to 3.2 g/cc for SiC).

$B_4C$ was incorporated into an Al-Li alloy of a composition within the 8090 specification. The reinforcement material, which was purchased from ESK in W. Germany, was particulate of F600 grade and exhibited a more equiaxed structure compared with the SiC used in the previous Examples.

The $B_4C$ was dried at 190° C. for 24 hours prior to incorporation. The melt spray temperature used was 748° C. The atomising gas was $N_2$ at a primary pressure of 0.17 MPa and a secondary pressure of 6.09 MPa. The deposit took approximately 115 s to spray and weighed 7.8 Kg. The approximate dimensions of the deposit were 140 mm diameter and 200 mm in length. The $B_4C$ content was 6.7% by volume.

We claim:

1. A metal matrix composite produced by spray deposition comprising an Al-Li alloy matrix and a reinforcement and having the following properties in an extruded and T6 age hardened state:

0.2% Proof strength—at least 400 MPa
Tensile strength—at least 440 MPa
Elongation—at least 2.0%
Modulus of elasticity—at least 85 GPa
Density—maximum 2.75 $Mg/m^3$ wherein the alloy matrix contains one or more of copper from 1.0% to 5.0% by weight; and zirconium from 0.04% to 0.20% by weight.

2. A composite as claimed in claim 1, containing from 5 to 30% by volume of the reinforcement.

3. A composite as claimed in claim 1, wherein the reinforcement is in the form of particles having a mean diameter in the range 5 to 40 microns.

4. A composite as claimed in claim 1, wherein the reinforcement is silicon carbide.

5. A composite as claimed in claim 1, wherein the reinforcement is boron carbide.

6. A composite as claimed in claim 1, wherein the lithium content of the metal matrix is from 1% to 3% by weight.

7. A composite as claimed in claim 1, produced by a method comprising the steps of atomising a stream of the molten Al-Li alloy to form a spray of hot metal particles by subjecting the stream to relatively cold gas directed at the stream, applying to the stream or spray fine solid particles of the reinforcement, and depositing the metal having said fine particles incorporated therein.

8. A composite as claimed in claim 1, wherein the Al-Li alloy matrix contains up to 0.5% by weight silicon.

9. A composite as in claim 1, wherein the Al-Li alloy matrix further contains one or more of copper 1.9% to 2.2% by weight; magnesium from 0.5% to 1.3% by weight; and zirconium from 0.04% to 0.16% by weight.

* * * * *